US006859964B1

(12) United States Patent
Arnott

(10) Patent No.: US 6,859,964 B1
(45) Date of Patent: Mar. 1, 2005

(54) CUSHION ASSEMBLY

(76) Inventor: Makenzie Rae Arnott, 24 Mikado Avenue, Kenora, Ontario (CA), P9N 3A7

( * ) Notice: Subject to any disclaimer, the term of this patent is extended or adjusted under 35 U.S.C. 154(b) by 0 days.

(21) Appl. No.: 10/815,783

(22) Filed: Apr. 2, 2004

(51) Int. Cl.[7] ..... A47G 9/00
(52) U.S. Cl. ..... 5/640; 5/636; 5/657; 5/922
(58) Field of Search ..... 5/640, 636, 645, 5/657, 653, 652, 922; D6/601, 600

(56) References Cited

U.S. PATENT DOCUMENTS 690,914 A * 1/1902 Bentley ..... 5/490
5,437,070 A 8/1995 Rempp
D397,575 S 9/1998 Miller
5,943,975 A 8/1999 von Burchard
6,574,810 B2 * 6/2003 Mangiaracina ..... 5/655
6,711,768 B2 * 3/2004 Maldonado ..... 5/636

* cited by examiner

*Primary Examiner*—Alexander Grosz
(74) *Attorney, Agent, or Firm*—Adrian D. Battison; Michael R. Williams; Ryan W. Dupuis

(57) ABSTRACT

A cushion construction includes a center cushion portion having superposed top and bottom cushions and a plurality of peripheral cushions, each formed from two fabric layers with a filling therebetween. An insert end of each peripheral cushion is inserted between the top and bottom cushions with the outer end exposed beyond such that all of the peripheral cushions can be arranged in an assembled condition at positions around the outer edge of the center cushion portion with the outer ends exposed to simulate petals of a flower. Patches of hook and loop fastening materials fasten each peripheral cushion between the top and bottom cushions and allowing release of the peripheral cushions and the center cushion portion for individual use.

9 Claims, 2 Drawing Sheets

CUSHION ASSEMBLY

This invention relates to a cushion assembly formed of a plurality of individual cushions which can be fastened together to form a common assembly of separated pillows/cushions for individual use.

BACKGROUND OF THE INVENTION

In U.S. Pat. No. 5,943,975 (von Burchard) issued Aug. 1, 1999 is disclosed a method of making a three dimensional flower shaped pillow/cushion. This is however very complex and leads to a structure which is potentially attractive but has little utility.

In U.S. Pat. No. 5,437,070 (Rempp) issued Aug. 1, 1995 is disclosed a relatively small integrated cushion structure simulating in plan view a flower with a center portion and center petals. However this is intended to provide different surfaces of a centered structure for a user to lie on.

In U.S. design patent D397,575 (Miller) issued Sep. 1, 1998 is disclosed an aesthetic design for a cushion in the form of a complex three dimensional flower.

While there are techniques for fabricating various pillows/cushions, none of these current techniques (that I am aware of) are capable of providing this type of multi-functional use all from one pillow/cushion source in such a sophisticated, funky, eye catching, compact invention.

I am not presently aware of any prior art references which relate to the method of manufacture taught in the present invention or the flower shaped pillow/cushion with removable petal pillow attachments produced thereby.

SUMMARY OF THE INVENTION

According to the invention there is provided a cushion assembly comprising:

- a center cushion portion having a top cushion and a bottom cushion each formed from two fabric layers with a filling therebetween;
- the top and bottom cushion having a fastening therebetween arranged to hold the top and bottom cushions superposed;
- and a plurality of peripheral cushions each formed from two fabric layers with a filling therebetween;
- each peripheral cushion having an insert end and an outer end;
- the insert end of each peripheral cushion being arranged to be inserted between the top and bottom cushions with the outer end exposed beyond an outer edge of the center cushion portion such that all of the peripheral cushions can be arranged in an assembled condition at positions around the outer edge of the center cushion portion with the outer ends exposed to simulate petals of a flower;
- and a plurality of releasably fastenable couplings each between the inner end of a respective peripheral cushion and the center cushion portion for holding the peripheral cushions in the assembled conditions and allowing release of the peripheral cushions and the center cushion portion for individual use.

Preferably the top and bottom cushions are permanently coupled.

Preferably the top and bottom cushions are coextensive.

Preferably the top and bottom cushions are coupled only at the center.

Preferably the releasable fastenable couplings each comprise cooperating hook and loop fastening patches.

Preferably the patches are provided on one fabric sheet of the respective peripheral cushion and an adjacent face of one of the top and bottom cushions.

Preferably the peripheral cushions are all identical in shape.

Preferably the peripheral cushions have in plan view a narrower inner end and a wider outer end.

Preferably the peripheral cushions have side edges which are in contact when in the assembled position.

The present invention provides a flower shaped pillow/cushion with removable petal pillows and the pillow/cushion products thereby. More particularly the invention provides for a method for a pillow/cushion which exhibits a soft feel, multi-functional usage, 6 pillow/cushions uniquely placed for optimum comfort and allows the user to experience multiple comfort from one unit/device. It keeps its shape and appearance after continual use (usage). The invention can provide:

- a multi-functional "comfort" apparatus;
- a pillow/cushion containing 5 extra removable pillows/cushions;
- a pillow/cushion of many, all in one compact unit.

A flower-shaped pillow/cushion having removable petal pillow attachments (A multi-functional pillow device; support system).

A pillow system which allows the user to remove a pillow/cushion or a multitude of pillow/cushion from one base unit to provide comfort to other areas of the body (detach or attach as required by the user.

The system provides six pillows in one.

The objectives of the invention are as follows:

To replace one pillow or cushion device with many pillows/cushions, all in one unit, six pillows/cushions to one pillow or cushion.

Six people could derive comfort from one unit.

You would have to buy six pillows or cushions to achieve the same comfort as what is provided in this one device.

Features of the invention that are new and distinguish it from what has come before.

Shape like a five petal flower with a center and base.

The petals are removable.

You can comfort up to six areas of the body with one unit.

The 'Petal Pillow' attachments can be removed or reattached in no particular order.

Up to six people can use this one device at the same time.

DESCRIPTION OF THE DRAWINGS

In the drawings like characters of reference indicate corresponding parts in the different figures.

DETAILED DESCRIPTION

Figure 1:
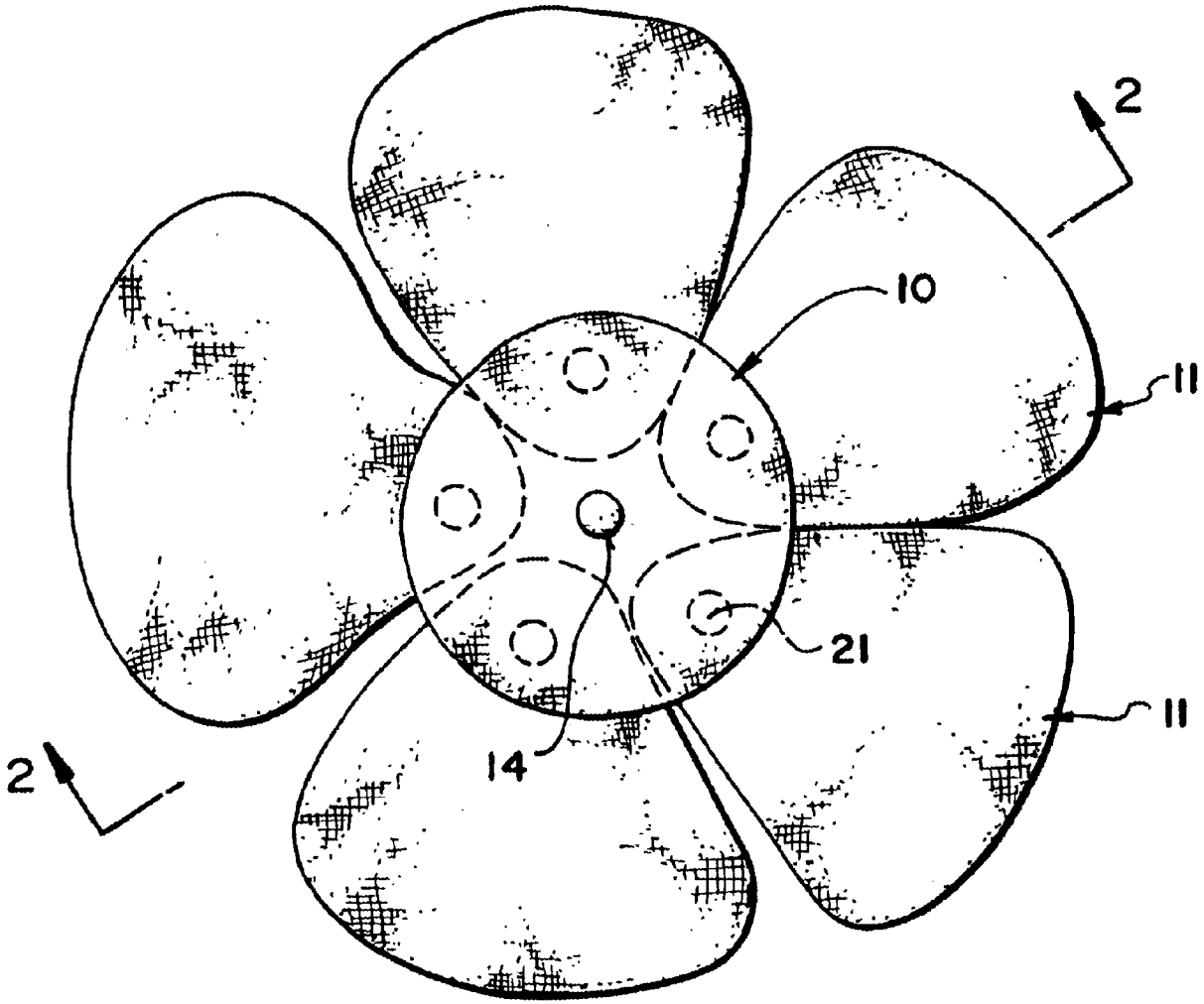
FIG. 1 is a top plan view of a cushion assembly according to the invention.
Figure 2:
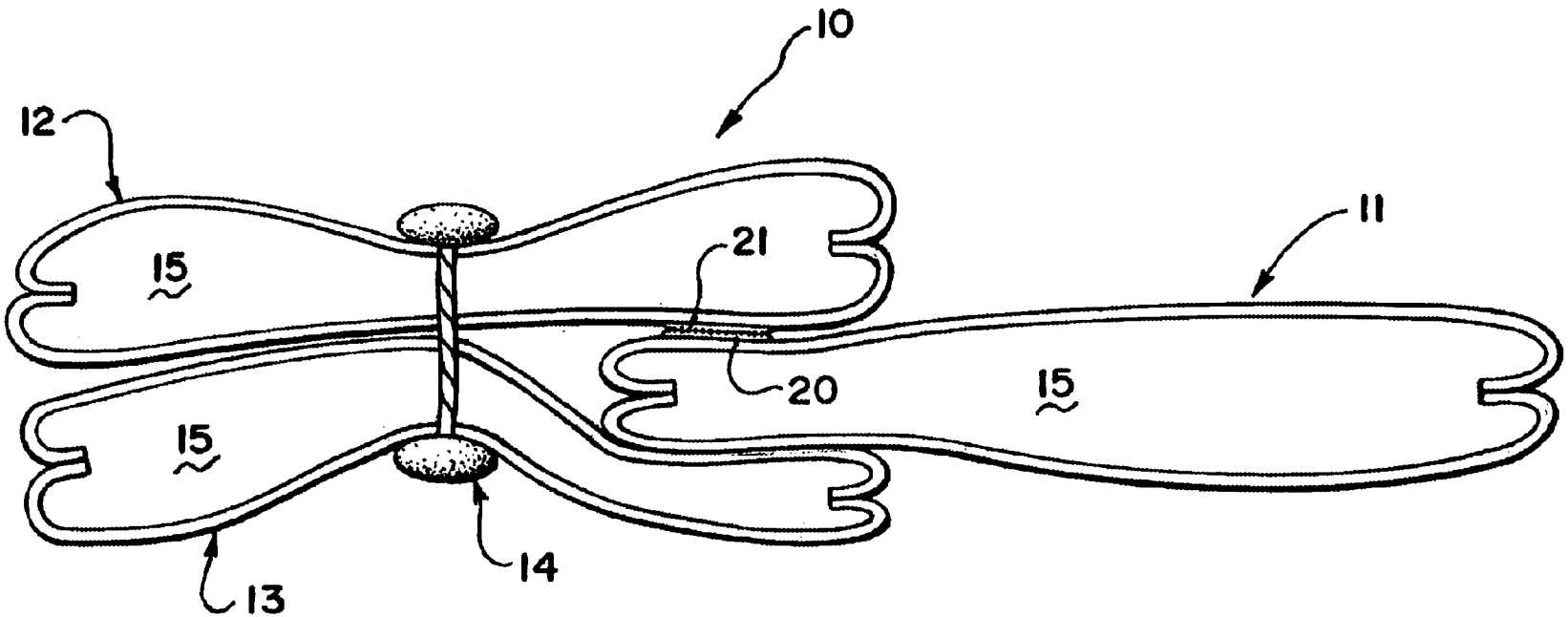
FIG. 2 is a cross sectional view along the lines 2—2 of FIG. 1.

A cushion assembly shown in the figures includes a central cushion portion 10 and a plurality of peripheral or petal cushions 11. The central portion is formed of a top cushion 12 and a bottom cushion 13 fastened together at a center coupling 14. The petal cushions are arranged around the periphery of the center portion at equidistantly positioned locations to simulate petals. The cushions are each formed of two layers of fabric stitched around the article edge and stuffed with a suitable filling 15.

The bottom face of each petal cushion carries a patch of a hook/loop fastener material which co-operates with a patch on the upper face of the bottom central cushion to hold the narrower inner end of the petal cushion between the faces of the top and bottom central cushions.

The basic principles of the method of manufacture of the flower shaped pillow/cushion with removable petal pillow attachments in accordance with the present invention are as follows:

The actual size of the flower shaped pillow/cushion with removable petal pillow attachments will depend on what the marketplace determines is the most appealing to the purchaser. The flower shaped pillow/cushion with removable petal pillow attachments can be more than one colour, it can be larger or smaller and it can be used with any type of fabric depending on the purchaser. The flower shaped pillow/cushion with removable petal pillow attachments does not have to be one uniform colour, and the colour can vary throughout the flower itself.

The flower shaped pillow/cushion with removable petal pillow attachments of the present invention has been designed in such a way that it can be mass produced with a minimum of individual variation.

All sewing lines can be pre-printed on the casing fabric (including those of the Velcro and Velcro placement for each petal attachment, center, and the base). They can also be given an individual number to ensure the correct placement and order of the steps necessary to complete the process.

It is contemplated that the techniques and method of fabrication of the flower shaped pillow with removable petal pillow attachments will be equally effective in the fabrication of pillows/cushions consisting of less or more petal pillow attachments as it is within the spirit and scope of my invention.

It is also contemplated that pillows/cushions which are similar in shape and, or other non-flower shaped constructions which resemble this inventions concept will be equally effective in the fabrication of other pillows/cushions as it is within the spirit and scope of my invention.

It will thus be seen that the objects set forth above among those made apparent from the preceding description have been efficiently attained. Since various modifications can be made in my invention as herein above described, and many apparently widely different embodiments can be made within the spirit and scope of the claims without departing from such spirit and scope, it is intended that all matter contained in the accompanying specification shall be interpreted as illustrative only and not in a limiting sense.

What is claimed is:

1. A cushion assembly comprising:

a center cushion portion having a top cushion and a bottom cushion each formed from two fabric layers with a filling therebetween;

the top and bottom cushion having a fastening coupling therebetween arranged to hold the top and bottom cushions superposed;

and a plurality of peripheral cushions each formed from two fabric layers with a filling therebetween;

each peripheral cushion having an insert end and an outer end;

the insert end of each peripheral cushion being arranged to be inserted between the top and bottom cushions with the outer end exposed beyond an outer edge of the center cushion portion such that all of the peripheral cushions can be arranged in an assembled condition at positions around the outer edge of the center cushion portion with the outer ends exposed to simulate petals of a flower;

and a plurality of releasably fastenable couplings each between the inner end of a respective peripheral cushion and the center cushion portion for holding the peripheral cushions in the assembled conditions and allowing release of the peripheral cushions and the center cushion portion for individual use.

2. The cushion assembly according to claim 1 wherein the top and bottom cushions are permanently coupled.

3. The cushion assembly according to claim 1 wherein the top and bottom cushions are coextensive.

4. The cushion assembly according to claim 1 wherein the top and bottom cushions are coupled only at the center.

5. The cushion assembly according to claim 1 wherein the releasable fastenable couplings each comprise co-operating hook and loop fastening patches.

6. The cushion assembly according to claim 5 wherein the patches are provided on one fabric sheet of the respective peripheral cushion and an adjacent face of one of the top and bottom cushions.

7. The cushion assembly according to claim 1 wherein the peripheral cushions are all identical in shape.

8. The cushion assembly according to claim 1 wherein the peripheral cushions have in plan view a narrower inner end and a wider outer end.

9. The cushion assembly according to claim 1 wherein the peripheral cushions have side edges which are in contact when in the assembled position.

* * * * *

UNITED STATES PATENT AND TRADEMARK OFFICE

CERTIFICATE OF CORRECTION

PATENT NO. : 6,859,964 B1
DATED : March 1, 2005
INVENTOR(S) : MacKenzie Rae Arnott It is certified that error appears in the above-identified patent and that said Letters Patent is hereby corrected as shown below:

Title page,
Item [76], Inventor, should read -- MacKenzie Rae Arnott --

Signed and Sealed this

Twenty-fourth Day of May, 2005

JON W. DUDAS
*Director of the United States Patent and Trademark Office*